US011147337B2

(12) United States Patent
Wood et al.

(10) Patent No.: US 11,147,337 B2
(45) Date of Patent: Oct. 19, 2021

(54) FOOTWEAR ARTICLE HAVING CORD STRUCTURE AND CONVERTIBLE HEEL STRAP

(71) Applicant: Fuerst Group, Inc., Menlo Park, CA (US)

(72) Inventors: Alicia Wood, Portland, OR (US); Rory Fuerst, Jr., Portland, OR (US)

(73) Assignee: Fuerst Group, Inc., Menlo Park, CA (US)

( * ) Notice: Subject to any disclaimer, the term of this patent is extended or adjusted under 35 U.S.C. 154(b) by 144 days.

(21) Appl. No.: 16/442,361

(22) Filed: Jun. 14, 2019

(65) Prior Publication Data

US 2019/0380425 A1 Dec. 19, 2019

Related U.S. Application Data

(60) Provisional application No. 62/685,826, filed on Jun. 15, 2018.

(51) Int. Cl.

| | |
|---|---|
| ***A43B 3/24*** | (2006.01) |
| ***A43B 3/12*** | (2006.01) |
| ***A43B 1/14*** | (2006.01) |

(52) U.S. Cl.

CPC ..... *A43B 3/126* (2013.01); *A43B 1/14* (2013.01); *A43B 3/242* (2013.01)

(58) Field of Classification Search

CPC ..... A43B 23/088; A43B 23/24; A43B 3/126; A43B 3/122; A43B 3/22; A43C 1/00; A43C 7/00; A43C 7/005

See application file for complete search history.

(56) References Cited

U.S. PATENT DOCUMENTS

| | | | | |
|---|---|---|---|---|
| D163,019 | S * | 4/1951 | Braun | D2/928 |
| 3,336,683 | A * | 8/1967 | Schellkopf | A43B 3/126 36/11.5 |
| 3,800,444 | A * | 4/1974 | Young | A43B 3/126 36/11.5 |

(Continued)

FOREIGN PATENT DOCUMENTS

| | | |
|---|---|---|
| FR | 2774562 A1 | 8/1999 |
| WO | 2008115824 A1 | 9/2008 |

OTHER PUBLICATIONS

"adjacent" The Free Dictionary by Farlex. Web. Aug. 2, 2019. https://www.thefreedictionary.com/adjacent.*

(Continued)

*Primary Examiner* — Jillian K Pierorazio

(74) *Attorney, Agent, or Firm* — McCoy Russell LLP

(57) ABSTRACT

A footwear article is provided herein. In one embodiment, a footwear article comprises a first cord forming a first plurality of loops, a second cord forming a second plurality of loops, the second plurality of loops slippably-engaged and intertwined with the first plurality of loops to form at least a portion of an upper configured to at least partially enclose a foot, and a heel strap comprising a heel counter and a connection cord, the connection cord fixedly intertwined with at least the first cord, the heel strap is adjustable from a first position to a second position. In this way, the footwear article may be converted from a first type of footwear article into a second type of footwear article.

15 Claims, 7 Drawing Sheets

(56) References Cited

U.S. PATENT DOCUMENTS

| | | | | | |
|---|---|---|---|---|---|
| 5,477,593 | A * | 12/1995 | Leick | A43C 7/00 | 24/712.5 |
| D376,042 | S * | 12/1996 | Cooper | D2/978 | |
| D437,991 | S * | 2/2001 | Matis | D2/902 | |
| D441,521 | S * | 5/2001 | Matis | D2/903 | |
| 6,237,249 | B1 | 5/2001 | Aguerre | | |
| 6,502,329 | B1 * | 1/2003 | Silagy | A43C 3/00 | 24/713.4 |
| D476,144 | S * | 6/2003 | Adams | D2/969 | |
| D545,550 | S * | 7/2007 | Matis | D2/969 | |
| D570,082 | S * | 6/2008 | Belley | D2/969 | |
| D715,531 | S * | 10/2014 | Cochrane | D2/973 | |
| D737,561 | S * | 9/2015 | Aveni | D2/971 | |
| D740,539 | S * | 10/2015 | Yun | D2/972 | |
| D769,590 | S * | 10/2016 | Aveni | D2/935 | |
| 9,510,638 | B2 * | 12/2016 | McDonald | A43B 3/128 | |
| D798,565 | S * | 10/2017 | Aveni | D2/971 | |
| D822,361 | S * | 7/2018 | Young | D2/972 | |
| D850,090 | S * | 6/2019 | Seamarks | D2/973 | |
| D893,852 | S * | 8/2020 | Owen | D2/971 | |
| 10,856,619 | B2 * | 12/2020 | Fuerst, Sr. | A43B 3/106 | |
| 2006/0288610 | A1 | 12/2006 | Laska et al. | | |
| 2007/0068041 | A1 * | 3/2007 | Farys | A43B 7/20 | 36/50.1 |
| 2008/0276492 | A1 | 11/2008 | Burnett | | |
| 2008/0301918 | A1 * | 12/2008 | Tai | A43C 7/04 | 24/712.2 |
| 2010/0018079 | A1 | 1/2010 | Albert | | |
| 2011/0088229 | A1 * | 4/2011 | Simmons | A43C 7/005 | 24/712.2 |
| 2013/0340285 | A1 | 12/2013 | Blowers | | |
| 2014/0130372 | A1 * | 5/2014 | Aveni | D04B 5/00 | 36/83 |
| 2014/0223779 | A1 * | 8/2014 | Elder | A43B 23/0245 | 36/103 |
| 2015/0047228 | A1 | 2/2015 | Pernia | | |
| 2015/0216252 | A1 | 8/2015 | Wiens | | |
| 2016/0113350 | A1 * | 4/2016 | Sashen | A43B 3/126 | 36/11.5 |
| 2016/0206044 | A1 * | 7/2016 | Dimoff | A43C 1/04 | |
| 2017/0079827 | A1 * | 3/2017 | Ostergard | A43B 7/20 | |
| 2017/0105486 | A1 * | 4/2017 | Klein | A43B 23/021 | |
| 2017/0105487 | A1 * | 4/2017 | Klein | A43C 1/04 | |
| 2017/0202296 | A1 * | 7/2017 | Fuerst, Jr. | A43B 3/00 | |
| 2017/0202310 | A1 * | 7/2017 | Spanks | A43B 13/122 | |

OTHER PUBLICATIONS

International Bureau of WIPO, International Preliminary Report on Patentability Issued in Application No. PCT/US2019/037378, dated Dec. 15, 2020, WIPO, 8 pages.

* cited by examiner

FOOTWEAR ARTICLE HAVING CORD STRUCTURE AND CONVERTIBLE HEEL STRAP

CROSS REFERENCE TO RELATED APPLICATIONS

The present application claims priority to U.S. Provisional Application No. 62/685,826, entitled "FOOTWEAR ARTICLE HAVING CORD STRUCTURE AND CONVERTIBLE HEEL STRAP", and filed on Jun. 15, 2018. The entire contents of the above-listed application are hereby incorporated by reference for all purposes.

BACKGROUND/SUMMARY

Footwear construction typically relies on the manipulation of flat materials into three-dimension shapes in order to form a footwear article. Cloth, leather, or other materials may be cut and sewn or otherwise attached and wrapped around a foot form to create a desired shape for the article, such as a footwear upper. Traditionally, the construction of footwear includes a multitude of steps such as sewing, boning, welding, pressing, knitting, weaving, and so on.

The inventors have recognized several drawbacks with this traditional approach. For example, footwear articles constructed using such methods typically have a fixed form, such as open-heel, closed heel, and so on.

To at least partially address the above issues, the inventors herein have taken alternative approaches to footwear construction. In one embodiment, a footwear article comprises a first cord forming a first plurality of loops, a second cord forming a second plurality of loops, the second plurality of loops slippably-engaged and intertwined with the first plurality of loops to form at least a portion of an upper configured to at least partially enclose a foot, and a heel strap comprising a heel counter and a connection cord, the connection cord fixedly intertwined with at least the first cord, the heel strap is adjustable from a first position to a second position. In this way, the footwear article may be converted from a first type of footwear article, such as a partially-closed-heel footwear article, into a second type of footwear article, such as an open-heel or slip-on footwear article, by simply adjusting the position of the heel strap.

BRIEF DESCRIPTION OF THE FIGURES

FIGS. 1 and 3-7 are shown to scale. However, other relative dimensions may be used if desired.

DETAILED DESCRIPTION

A footwear article including a cord structure with a convertible heel strap is provided herein. Such a cord structure may comprise a corded upper in a footwear article, such as the footwear article depicted in FIG. 1. A cord structure may include interconnected loops of different cords, as depicted in FIG. 2, which form a three-dimensional structure. A person may attempt to wear a footwear article differently than designed. For example, a person may wear a closed-heel footwear article as an open-heel footwear article by stepping on the heel counter, possibly damaging the heel counter. To expand the functionality of a footwear article by enabling the person to convert the footwear article from a first type of footwear article (e.g., a closed-heel footwear article) to a second type of footwear article (e.g., an open-heel footwear article), a footwear article may include a convertible heel strap, such as the convertible heel strap depicted in FIGS. 3-7, which is fixedly intertwined with the cord structure and adjustable from a first position to a second position.

Figure 1:
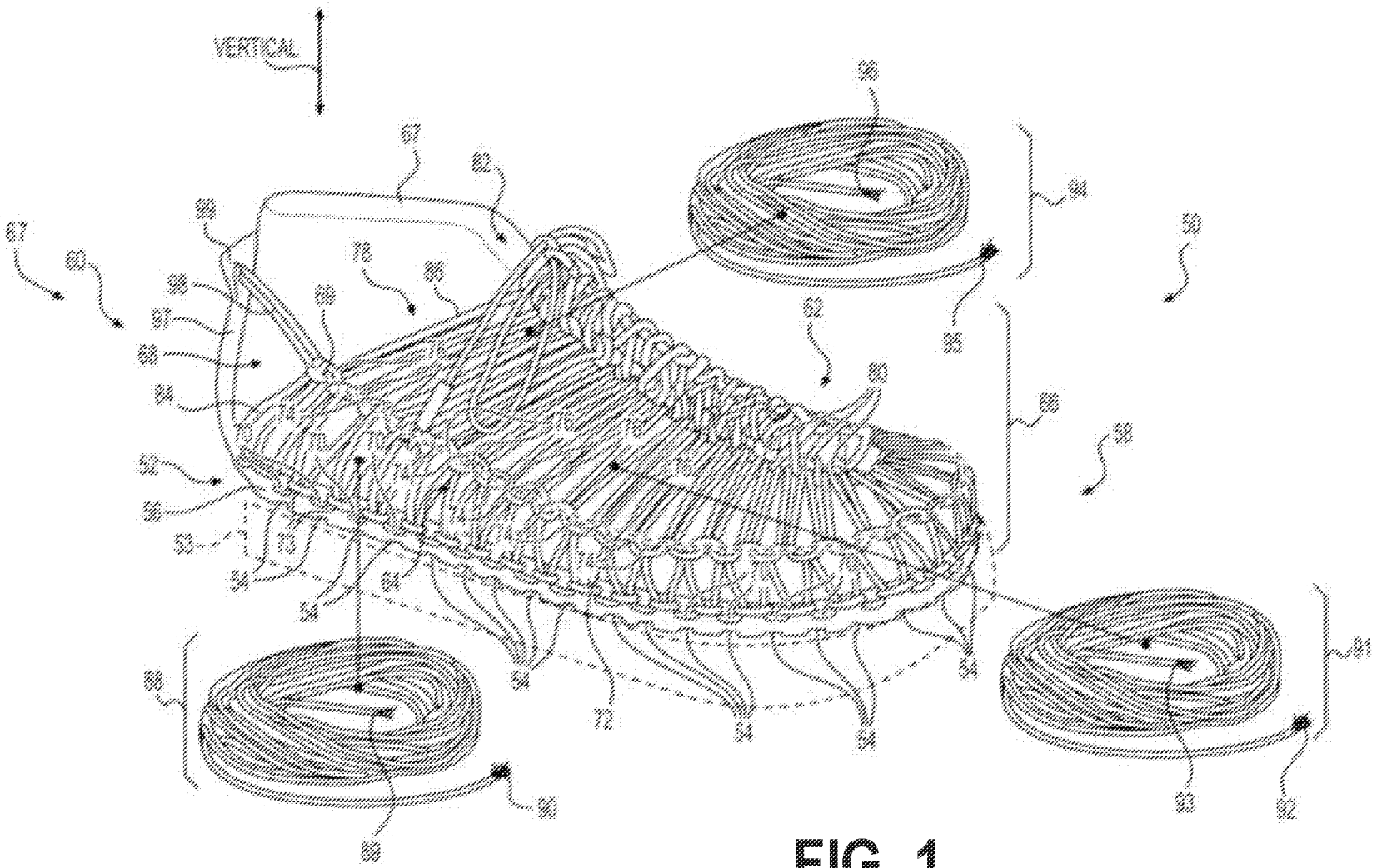
FIG. 1 shows an example of a footwear article.
Figure 2:
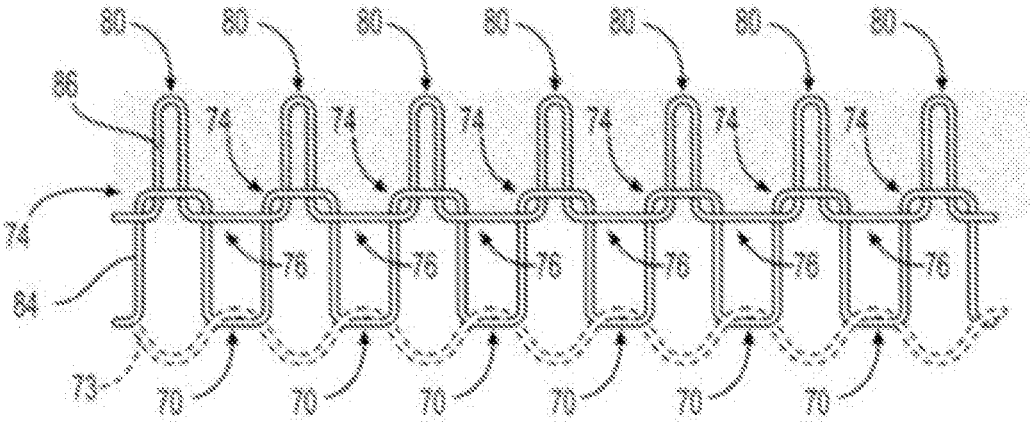
FIG. 2 shows an example intertwined pattern of cords in the footwear article shown in FIG. 1.

The footwear article, an example of which is depicted in FIG. 1, may include interconnected bights in a cord structure providing a 3-dimensional form fitting construction. The cord structure increases the range of motion of an upper part of the footwear article while retaining flexibility and comfort. The cord structure may conform highly to the shape of a foot during use due to the relative movement provided by the bights. For example, by providing an array of bight interconnections across the upper from a lateral to medial side, and across a forefoot region, hundreds of adjustments, for example, can be automatically made by the cord structure so that the appropriate lengths of each cord section between the bights are achieved. As a result, the comfort provided by the footwear article is increased.

Further, in some examples, the cord structure may include an anchor cord positioned away from a sole of the footwear article. The remainder of the cord structure may be coupled to the anchor cord through an array of bight connections. In this way, the cord structure can be tensioned independent of other upper materials, thereby enabling a more precise fit and increased functionality of the cord structure.

The example cord structures described herein also enable the manufacturing process of the footwear article to be simplified when compared to other types of shoe construction which use a foot form.

FIG. 1 shows an example footwear article 50. The footwear article 50 may include a sole 52. The sole 52 may be an insole/midsole, in one example. In some examples, the insole and midsole may be single component in the footwear article. However, in other examples, the sole may be a transition material, such as, but not limited to, a cloth-like material that is used during the described production methods to form a portion of the sole or outsole and/or to secure the footwear for formation of the sole or outsole. Further still, in other examples, the insole and midsole may be separate components in the footwear article. Moreover, in one example, the footwear article 50 may also include an outsole. However, in other examples the footwear article 50 may not include an outsole or the outsole may be integrated into the sole 52.

The sole 52 is attached to a cord structure 66. The cord structure 66 is included in an upper 67. The cord structure may be formed from numerous cord sections interlocking with one another. The cord may include string, twine, yarn, rope, cable, strands of braided or twisted materials, and/or other cord-like structures including combinations of the previously listed examples twisted together or otherwise combined. In one example, the cord includes nylon cord of approximately a ⅛" diameter, with an outer sheath and inner twine. Of course, other sizing may also be used. In another example, the cord may be double braided nylon, with an inner braid filling a central void and an outer braid that may be of the same or different material. The cord may be flexible yet retain some of its shape in a free state. Further, the cord may have some elastomeric components. Further, different cord sections (e.g., the vamp as compared to the rand) may have different degrees of flexibility, elasticity, etc. In one example, different materials may be used in different sections of the cord structure 66. For instance, a more flexible type of cord may be used in an upper portion of the cord structure 66 and a less flexible type of cord may be used in a lower portion of the cord structure. Additionally, the portions of the cord structure coupled to the sole may be totally covered via the sole, in one example. In another example, the portions of the cord structure coupled to sole the may only be partially covered. For instance, portions of the cord structure proximate to the toes may be covered while portions of the cord structure, proximate to a heel, may be uncovered or vice-versa. Covering portions of the cord structure reduces the likelihood of premature wear of the cord caused by abrasions from rocks, dirt, and/or other particulates from the external environment. As a result, the footwear article's longevity is increased.

In one example, one or more cords in the cord structure 66 may extend through openings in the sole 52 to facilitate coupling of the sole to the cord structure. Additionally alternatively, a portion of the cord structure may be stitched, adhesively bonded (e.g., glued), and/or snapped into the sole to enable the coupling of the sole and the cord structure. In another example, a plurality of anchor points attached to the cord structure may be fixedly attached (e.g., injection molded into) to the sole. The anchor points may be individual cord loops.

In one example, the cord structure 66 may be a looped upper. In such an example, the looped upper may be formed in a grid-like pattern, but substantially free of knots at a plurality of the slippable interfaces positioned away from the sole 52.

The cord structure 66 may be an upper of the footwear article 50. The cord structure 66 may at least partially enclose a foot. The cord structure 66 includes a rand substructure 68. The rand substructure is coupled to the sole 52. Specifically in one example, sole attachment bights in the rand substructure 68 may be coupled to and/or extend through attachment openings in the sole. In one example, the attachment bights may be formed via a single cord in the rand substructure 68. Thus, a single cord may have multiple bights. A bight is a curved portion or section of a greater cord in the cord structure 66. Thus, a bight may be a portion of a loop in a cord.

The rand substructure 68 further includes vamp attachment bights 74. The vamp attachment bights 74 are coupled (e.g., interconnected, interlocked, stitched, intertwined, and/or slidingly engaged) to rand attachment bights 76 included in a vamp substructure 78 in the cord structure 66. The interconnection between the vamp attachment bights 74 and the rand attachment bights forms a loop line 69. The loop line 69 may be an interface between the rand substructure 68 and the vamp substructure 78. The loop line 69 extends in a direction from a heel side 60 of the footwear article 60 to a toe side 58 of the footwear article. The loop line 69 also extends from a tibular side 62 of the footwear article 50 to a fibular side 64 of the footwear article. The loop line 69 may peripherally extend around the footwear article, and in one example may traverse around the entire upper. Further it will be appreciated that the loop line 69 may extend in an arc around at least a portion of the footwear article 50. Other loop line configurations have been contemplated. For instance, the loop line may extend across the footwear article from a first later side to a second lateral side. Further in another example, the loop line may extend around the footwear article in an arc, from a first side of a heel counter to a second side of a heel counter. Still further in another example, the loop line may laterally extend across the footwear article as well as extend in an arc around a front of the footwear article (e.g., toe side). Even further in another example, the loop line may only extend around a portion of the footwear article, such as a portion adjacent to a toe side or a heel side of the footwear article. Further still in one example, the footwear article may include a plurality of loop lines.

The vamp substructure 78 is spaced away (e.g., vertically spaced away) from the sole 52, in the depicted example. Additionally, the rand substructure 68 may be positioned vertically above the sole 52 and the vamp substructure 78 may be positioned vertically above the rand substructure. A vertical axis is provided for reference. However, it will be appreciated that other footwear article orientations may be used if desired. It will be appreciated that the vamp substructure 78 may be spaced away from the sole 52 when the footwear article is not being worn. The cord structure 66 may retain it shape due to the interconnection between the vamp substructure 78 and the rand substructure 68, along with the internal structure of the cord. Example interconnections are discussed in further detail herein.

FIG. 2 shows a more detailed view of the at least partially sliding interconnection between the vamp attachment bights 74 and the rand attachment bights 76. It will be appreciated that the vamp attachment bights 74 are shown interlocked with rand attachment bights, as depicted in FIG. 2. In this way, the vamp substructure may be coupled to the rand substructure without the use of adhesive, if desired. However, it will be appreciated that in some examples adhesives may be used to couple certain elements in the footwear article. In one example, the sliding connection between the bights may be free of knots. However in another example, at least a portion of the vamp attachment bights 74 may be fixedly coupled to at least a portion of the rand attachment bights 76. In another example, stitched locks may be used to provide the partially sliding interconnection. For instance, loose or tight stitched interfaces may be provided at the junctions of the cords in the upper. By controlling the amount of slippable engagement in various sections of the footwear article desired fitting characteristics may be achieved to increase the wearer's comfort.

It should be appreciated that the cord structure depicted in FIGS. 1 and 2 includes a first loop of the first plurality of loops (e.g., the rand substructure) is intertwined with and slidably movable relative to at least two loops of the second plurality of loops (e.g., the vamp substructure), and a second loop of the at least two loops is intertwined with and slidably movable relative to at least two loops of the first plurality of loops including the first loop. Such a loop configuration enables the slippably engaged and durable cord structure depicted in FIGS. 1 and 2.

Returning to FIG. 1, the vamp substructure 78 further includes lace attachment bights 80. The lace attachment bights 80 are shown coupled to a lace cord 82 in FIG. 1. Specifically, the lace cord 82 extends through the lace attachment bights 80. The length of the lace cord 82 may be adjusted by the wearer. However, alternate lace cord configurations have been considered. For instance, the footwear article may be constructed without a lace cord. In this way, a wearer can quickly and easily slip on and off the footwear article without the need to tie a lace cord. In such an example, elastic material may be provided in the footwear article to enable controlled expansion and contraction of portions of the cord structure. Additionally, different lacing patterns have been considered. For instance, the cord structure may include eyestays. Cords in the cord structure may extend through the eyestays.

The lace cord 82 may be included in the cord structure 66, in some examples. However, in other examples the lace cord 82 may not be included in the cord structure 66. In such an example, elastic or other suitable material may be used to provide the footwear article with a slip-on capability.

Numerous relative vamp cord, rand cord, and/or lace cord lengths have been contemplated. Portions of the rand cord 84 and the vamp cord 86 are also shown in FIG. 2. The sole attachment bights 70 are also shown in FIG. 2. As illustrated, the sole cord 73 (also referred to herein as the anchor cord) is intertwined with the sole attachment bights 70.

It should be appreciated, that the construction method described herein enables, in some embodiments, options for customizing sizing and for adjusting sizing with minimal tooling expenditures. For example, the construction of the upper based on a cord length enables variation in size without changing the upper pattern or obtaining different size cutting dies. As such, in some embodiments, the size of the upper can be altered by varying the cord length. The loops may remain in their relative position for each size. Such construction reduces costs by utilizing same size tooling.

Likewise, customization of the footwear may be applied to improve fit for a specific user. With generation of an electronic scan of a foot, a customized and personalized cord may be used to generate customized footwear based on the foot scan. For example, the lengthening (or shortening) of the loops, the positioning and sizing of the loop line, and the adjustment of cord size may be adjusted alone or in combination to tailor the upper to the specific dimensions of the scanned foot to provide a customized fit.

Turning back to FIG. 1, the rand cord 84 and the vamp cord 86 are depicted as being round cords in FIG. 1. However, other shapes have been contemplated. For instance, one or more of the cords may be flat cords or one or more of the cords may have flat ends and round midsections. In another example, one or more of the cords may have one or more flat sections and one or more round sections. For instance, a cord may include a round section followed by a flat section and so on and so forth. Additionally, the sole cord 73 may be flat, round, or have different sections with varying geometries. Additionally, the rand cord 84, the vamp cord 86, and the lace cord 82 are all depicted as having a similar cross-sectional area (e.g., diameter) and/or geometry. In one example, the diameter of one or more of the cords may be between $1/8^{th}$ of an inch and $1/16^{th}$ of an inch. However, in other examples the cords may have varying widths. It will be appreciated that the sole cord 73 may have a similar geometry to the rand cord, vamp cord, and/or lace cord, in one example. However, in other examples, the cross-sectional area and/or geometry of the rand cord 84, the vamp cord 86, sole cord 73, and/or lace cord 82 may vary. For example, the cross-sectional area of the rand cord may be larger than the vamp cord. In another example, the rand cord may be circular and the vamp cord may be flat.

Further in some examples, the rand cord 84, vamp cord 86, and/or lace cord 82 may comprise similar material(s). However, in other examples the aforementioned cords may comprise different materials. One or more of the cords may comprise synthetic fibers such as Polypropylene, Nylon, Polyester, Polyethylene, Aramid, and/or Acrylate polymer. Additionally, one or more of the cords may comprise natural fibers such as cotton, linen, coir, etc. Further in one example, one or more of the cords may comprise a polymeric material.

Additionally, the rand cord 84, vamp cord 86, and/or lace cord 82 may be designed with different material properties to enable the footwear article have desired structural characteristics. For example, the lace cord 82 may have a greater elasticity than the rand cord 84 and/or the vamp cord 86.

As shown in FIG. 1, the vertical height of the vamp attachment bights increases in a reward direction extending toward the heel side 60 of the footwear article 50. The width of the interlocked vamp cord sections extending from the lace cord to the rand cord may also increase in the reward direction extending toward the heel side 60 of the footwear article 50.

The footwear article 50 also includes a heel counter 97. The heel counter or other support structures in the footwear article may be included in the upper discussed above. It will be appreciated that the rigidity/flexibility of the heel counter 97 may be selected to provide a desired amount of support to the cord structure 66. Specifically, the heel counter 97 may prevent the cord structure from flexing outward and/or downward in a direction toward the sole by an undesirable amount. In this way, the cord structure may maintain a desired shape. As a result, a wearer of the footwear article may quickly and comfortably put on and take off the footwear article. The heel counter 97 may comprise a different material than the cord structure 66, such as leather, synthetic leather, fabric, etc. However, in some examples the heat support structure may also comprise cord. The loop line 69 may extend through the heel counter 97 in some examples. Additionally, the heel counter 97 may be coupled to the sole 52. Specifically, in some examples the heel counter structure may extend (e.g., vertically or angularly) from the sole 52. The heel counter 97 is coupled to the rand substructure 68, in the depicted example. A connection cord 98 is shown extending through bights in the rand substructure 68 and through an opening 99 in the heel counter 97. In this way, the heel counter 97 provides support to the cord structure as well as shields a portion of the cord structure from the external environment. Additionally or alternatively, the heel counter 97 may be coupled to the vamp substructure 78, thereby providing support to the substructure. The heel counter may have a greater rigidity than the cord structure 66. In one example, the connection cord 98 may be a portion of the vamp cord 86 or the rand cord 84. Additionally, a portion of the cord structure extends around the width of the heel counter 97. However, other heel counter configurations have been contemplated. In one example, ends of cords in the cord structure may be coupled to the heel counter and/or coupled to one another within the heel counter. In one example, the heel counter 97 may have greater stiffness in a longitudinal direction than a lateral direction. The vertical stiffening of the support may provide a desired amount of support to the cord structure. However, other heel counter 97 material characteristics have been contemplated.

In some examples, the heel counter 97 may extend to the sole 52 as depicted in FIG. 1. However, as discussed further herein, in some examples the heel counter 97 may not be integrally formed with the sole 52, but instead may comprise a distinct component of the upper 67 coupled to the cord structure 66 via the connection cord 98. In such examples, the heel counter 97 may be convertible from a first position, wherein the heel counter 97 is provided against a heel of a foot inserted into the footwear article 50, to a second position, wherein the heel counter 97 is in contact with the lace cord 82 and the footwear article 50 functions as a slip-on footwear article. Such examples are described further herein with regard to FIGS. 3-7.

The footwear article 50 shown in FIG. 1 may further include an eyestay (not shown). Cords in the cord structure 66 may extend through the eyestay. It will be appreciated that more than one cord section extends though the eyestay, in the depicted example. However in other examples, alternate eyestay designs have been contemplated. The eyestay may provide desired cord spacing and cord support to the cord structure. In this way, the eyestay may limit the free movement of the cords extending therethrough. The eyestay may be included in an upper structure. In one example, the upper structure may be adjacent to a tongue of the footwear article. The upper structure may comprise a different material than the cord structure, in one example. Example eyestay materials include cloth, leather, synthetic leather, fabric, polymeric material, etc. In other examples, the footwear article may include a plurality of eyestays.

Additionally, one or more sheaths may enclose (e.g., circumferentially enclose) a portion of at least one of the rand cord 84 and vamp cord 86, in some examples. Therefore, the sheaths may surround various sections of the cords in the cord structure. For instance, a plurality of sheaths may surround a portion of the rand cord 84 from vamp attachment bights 74 to the rand attachment bights 76. Thus, the sheaths may act as protective covers for the cords. In some examples, the sheath may be in face sharing contact with an outer surface of the cord. However, in other examples, the sheath may be spaced away from an outer surface of the cord. The sheaths may be cylindrical, in one example. However, other sheath geometries have been contemplated. Additionally, a plurality of sheaths may be used to form a toe cap around the toe side of the footwear article. The sheaths may provide increased structural integrity to desired areas of the cord structure 66, to enable the cord structure 66 to retain a desired shape. The sheaths may comprise a different material than the vamp cord and/or the rand cord. In one example, the sheaths may comprise a polymeric material. The sheaths may also protect the cords from damage.

The footwear article may be manufactured using a double lasted strobel and string construction, which allows the various upper parts—the cord structure and the upper structures—to act independent of each other. These upper parts are integrated together by the laces at the lace attachment bights.

Figure 3:
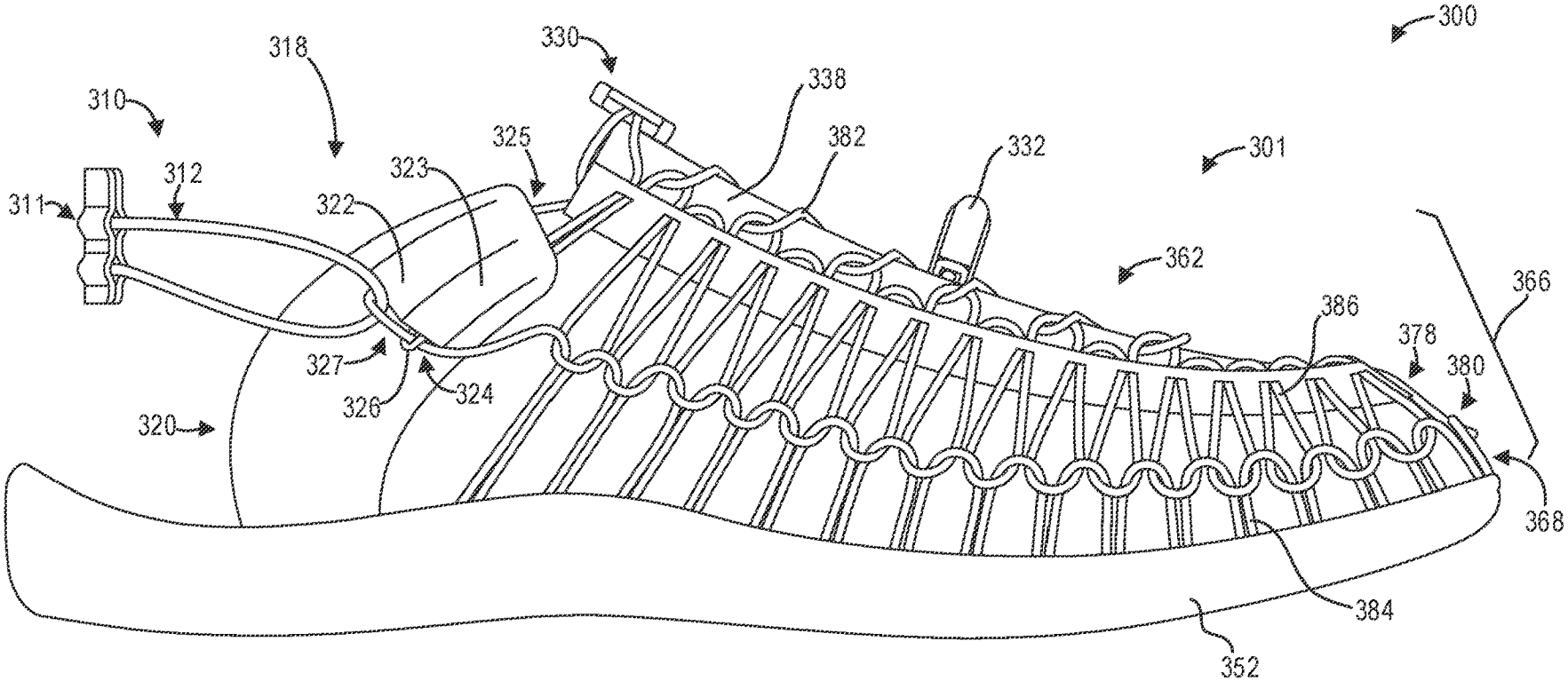
FIG. 3 shows a lateral side view of an example footwear article including a convertible heel strap in a first position.
Figure 4:
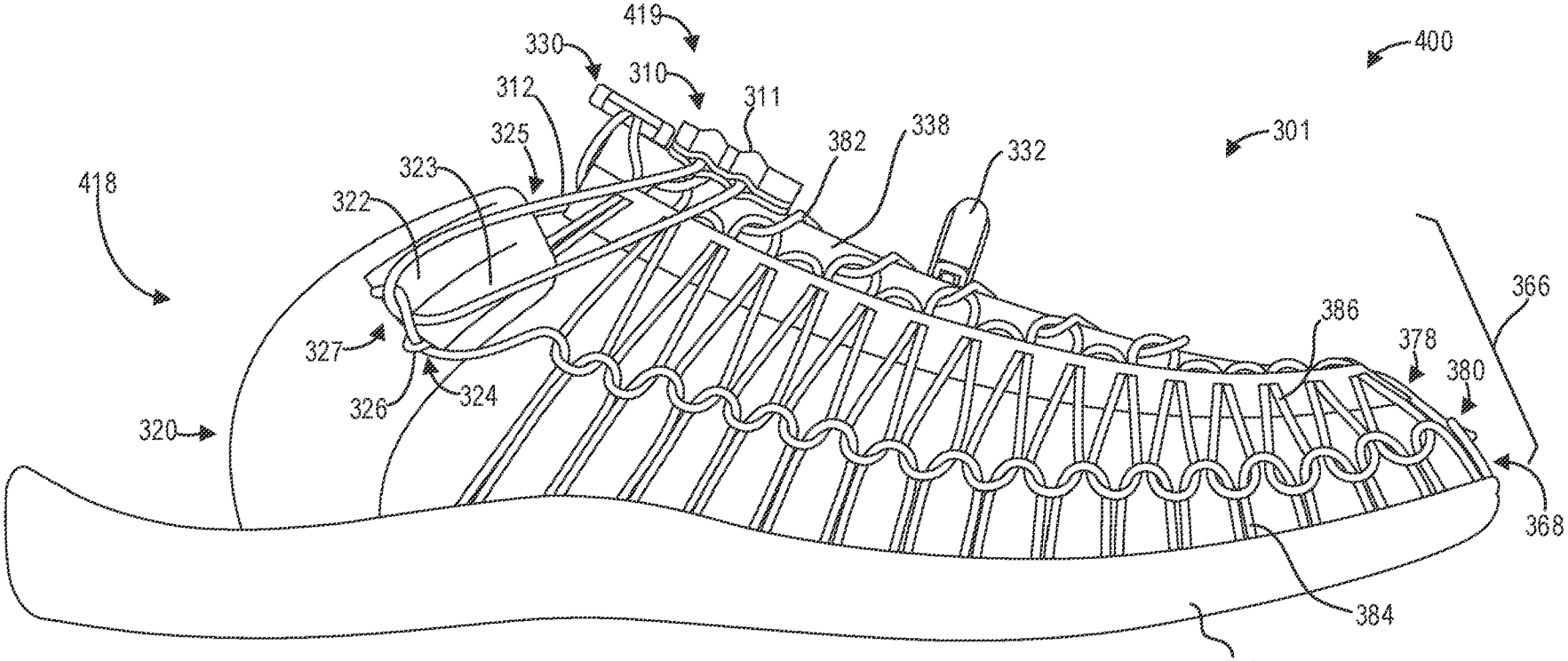
FIG. 4 shows a lateral side view of the example footwear article of FIG. 3 with the convertible heel strap in a second position.

As discussed hereinabove, the heel counter 97 of the footwear article 50 may be configured as a convertible heel strap to expand the functionality of the footwear article 50 according to the position of the heel counter 97. As an illustrative example, FIG. 3 shows a lateral side view 300 of an example footwear article 301 including a convertible heel strap 310 in a first position 319, while FIG. 4 shows a lateral side view 400 of the footwear article 301 including the convertible heel strap 310 in a second position 419. As depicted, when the convertible heel strap 310 is in the first position 319, a foot placed within the footwear article 301 through the opening 318 is secured by the convertible heel strap 310 to the footwear article 301. In contrast, when the convertible heel strap 310 is in the second position 419, a foot may be loosely placed or slipped into the footwear article 301 through the openings 418. Thus, by positioning the convertible heel strap 310 into the first position 319 or the second position 419, the footwear article 301 may be converted from a semi-closed footwear article to an open-heel footwear article, respectively.

The footwear article 301 may be constructed similarly to the footwear article 50 described hereinabove with regard to FIG. 1. For example, the footwear article 301 may comprise an upper 362 formed from a cord structure 366. The cord structure 366 comprises a rand substructure 368 formed by a rand cord 384 and a vamp substructure 378 formed by a vamp cord 386, wherein the rand substructure 368 and the vamp substructure 378 are coupled via rand and vamp attachment bights as depicted. The rand substructure 368 may be coupled to the sole 352 of the footwear article, while a lace cord 382 may be intertwined with the vamp substructure 378 as depicted. Further, the ends of the lace cord 382 may be fixedly coupled to one or more lace locks, such as lace lock 330 and lace lock 332, which enable the tension of the lace cord 382 to be adjusted without the need for tying the lace cord 382.

The upper 362 of the footwear article further includes an upper structure 320 through which the vamp cord 386 and/or the rand cord 384 are coupled to, as shown. In some examples, the upper structure 320 includes a first channel 322 and a second channel 323, wherein the first and second channels 322 and 323 have openings on a first end 324 of the channels as well as opening on a second end 325 of the channels. As depicted, the rand cord 384 is threaded through the first channel 322 while the vamp cord 386 is threaded through the second channel 323. The vamp cord 386 exits the second channel 323 at the first end 324, loops around a portion of the rand cord 384 extending from the first channel 322 at the first end 324, and passes back through the second channel 323 toward the vamp substructure 378. The upper structure 320 comprises a fabric upper structure formed from a textile or other material, such as leather, constructed as depicted in FIG. 3, in contrast with the cord structure 366 formed from cords. The upper structure 320 is fixedly coupled to the sole 352 of the footwear article 301, in some examples as depicted.

Figure 5:
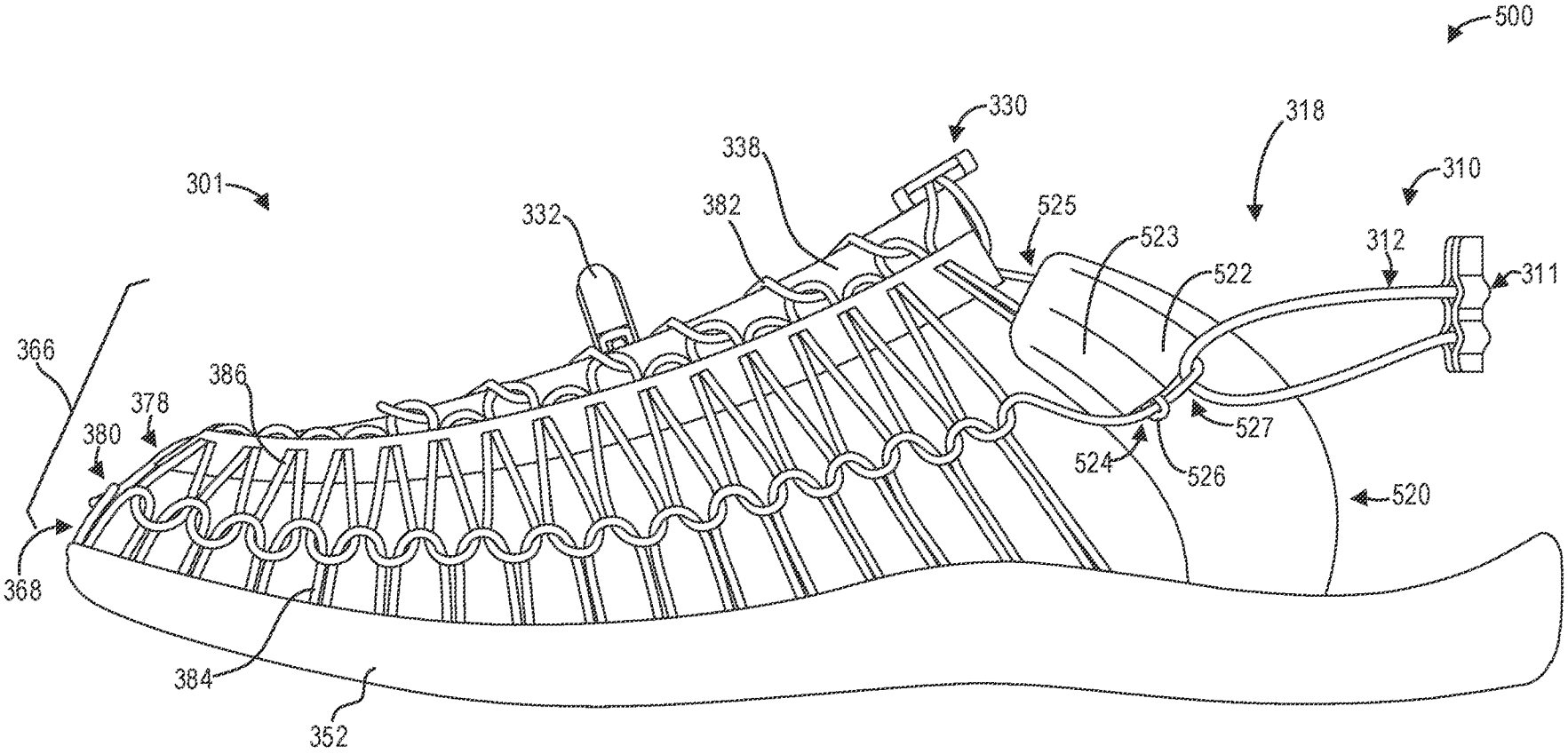
FIG. 5 shows a medial side view of the example footwear article of FIG. 3 with the convertible heel strap in the first position.

Further, the rand cord 384 extends from the second end 325 of the first channel 322 to pass the tongue 382 towards a second upper structure 520 on a medial side of the footwear article 301. For example, FIG. 5 shows a medial side view 500 of the footwear article 301. On the medial side of the footwear article 301, the footwear article 301 comprises the second upper structure 520 positioned opposite the upper structure 320. The relative positions of the upper structure 320 and the second upper structure 520 is also clearly shown in the rear medial perspective view 600 of the footwear article 301 depicted in FIG. 6, as well as the top view 700 of the footwear article 301 depicted in FIG. 7.

Referring again to FIG. 5, the second upper structure 520 includes a third channel 522 and a fourth channel 523, similar to the first channel 322 and the second channel 323 of the upper structure 320. As mentioned above, the rand cord 384 extends from the second end 325 of the first channel 322 of the upper structure 320, past the tongue 382, and extends through the third channel 522 to continue forming the rand substructure 368. Thus, as depicted, the rand cord 384 extends around a periphery of the footwear article 301 to form the rand substructure 368, and passes through the first channel 322 and the third channel 522 of the upper structure 320 and the second upper structure 520, respectively. In some examples, the rand cord 384 may terminate at the tongue 338. For example, the rand cord 384 may be secured by one or more of the lace locks such as the lace lock 330, other may otherwise be secured by adhesives in other examples.

Further, the vamp cord 386 passes through the fourth channel 523 of the second upper structure 520 to form a loop 526 around the rand cord 384 at the first end 524 of the channels 522 and 523. That is, the vamp cord 386 passes through the second end 525 of the fourth channel 523, exits the first end 524 of the fourth channel 523, loops around the rand cord 384 at the first end 524, passes back through the fourth channel 523, and exits the fourth channel 523 at the second end 525 of the fourth channel 523 to rejoin the vamp substructure 378.

The convertible heel strap 310 comprises a heel counter 311 and a connection cord 312 coupled to the heel counter 311. The heel counter 311 may comprise a different material than the cord structure 366, such as leather, synthetic leather, fabric, and so on. The connection cord 312 comprises one or more cords that are fixedly intertwined with and moveable relative to at least the rand cord 384, as depicted, by forming a connection loop 327 along the loop line formed by the vamp substructure 378 and the rand substructure 368. Specifically, the connection cord 312 forms the connection loop 327 at the portion of the rand cord 384 between the first end 324 of the first channel 322 and the loop 326 formed by the vamp cord 386 at the first end 324 of the second channel 323. Further, the connection cord 312 forms the connection loop 527 at the portion of the rand cord 384 between the first end 524 of the first channel 522 and the loop 526 formed by the vamp cord 386 at the first end 524 of the fourth channel 523. The connection cord 312 further couples the heel counter 311 to the footwear article 301 by passing through one or more channels, as depicted, formed in the heel counter 311.

To convert the footwear article 301 from a semi-closed footwear article to an open-heel footwear article, a person wearing the footwear article 301 may simply remove the foot from the opening 318 of the footwear article 301, adjust the position of the convertible heel strap 310 from the first position 319 to the second position 419, and re-insert the foot into the footwear article 301 through the opening 418 of the footwear article 301 defined by adjusting the position of the convertible heel strap 310 to the second position 419.

As the convertible heel strap 310 is adjusted from the first position 319 to the second position 419, the convertible heel strap 310 pivots around the connection loop 327 at the first end 324 of the first channel 322 such that an interior surface of the heel counter 311 is in face-sharing contact with the footwear article 301, in particular with the lace cord 382 and/or the tongue 338 of the footwear article 301. The heel counter 311 may be secured in place by the lace lock 330, in some examples. For example, by positioning the heel counter 311 adjacent to the lace lock 330, the heel counter 311 is prevented from sliding upwards. Further, in some examples the heel counter 311 may be secured in the second position 419 by positioning the heel counter 311 under at least a portion of the lace lock 330, such that the exterior surface of the heel counter 311 is in face-sharing contact with at least a portion of an interior surface of the lace lock 330.

Figure 6:
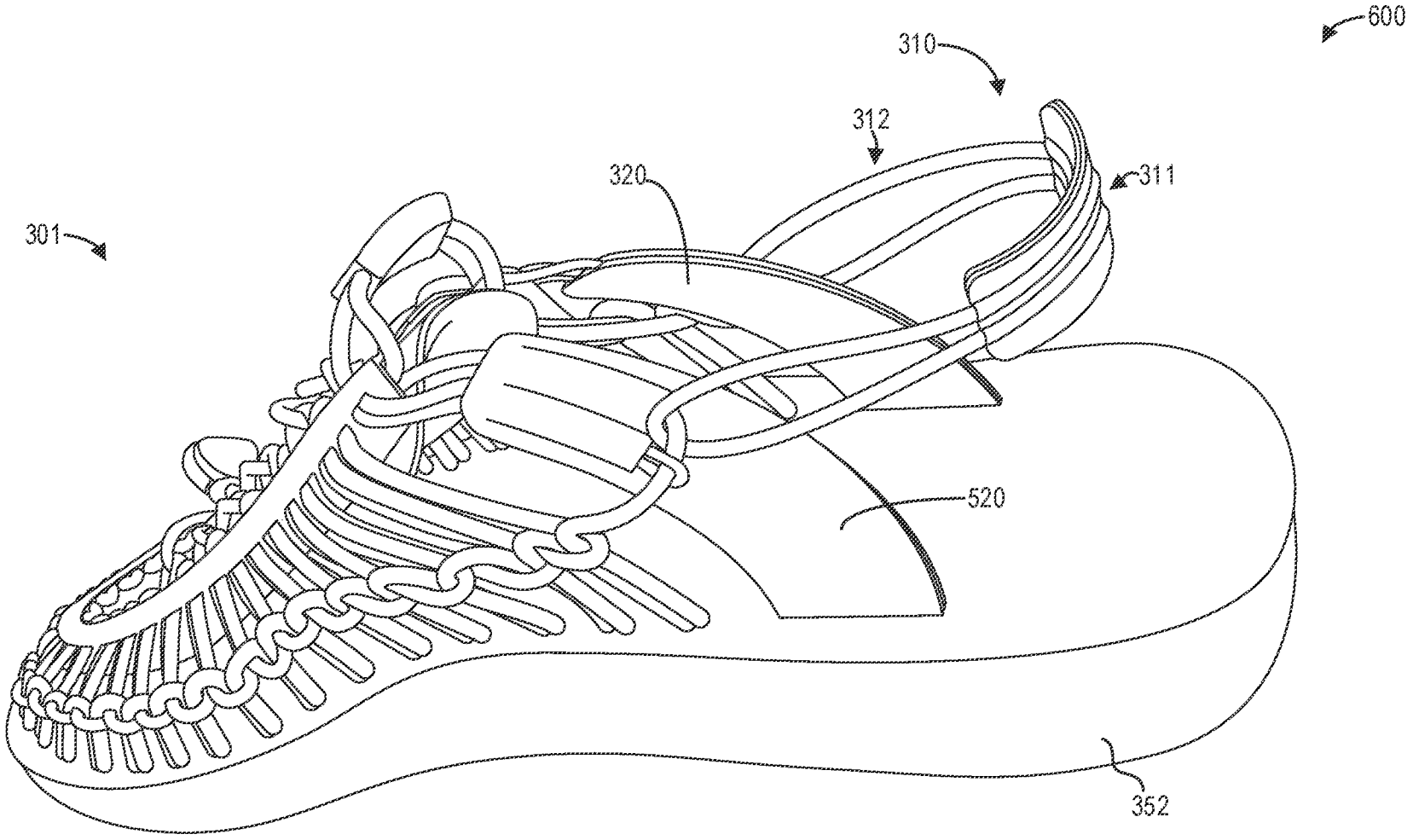
FIG. 6 shows a rear lateral perspective view of the example footwear article of FIG. 3 with the convertible heel strap in the first position.
Figure 7:
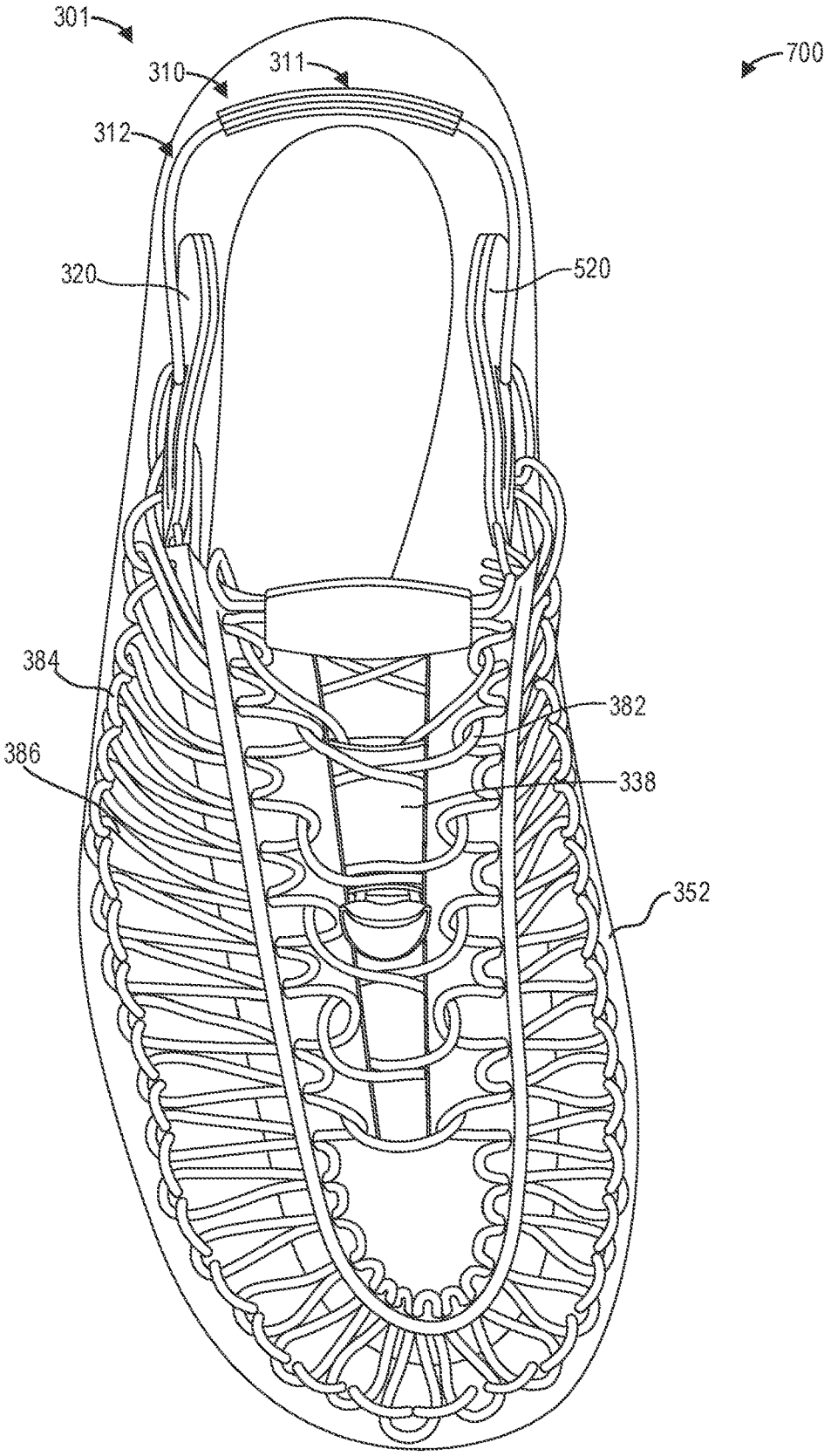
FIG. 7 shows a top view of the example footwear article of FIG. 3 with the convertible heel strap in the first position.

FIG. 5 shows another perspective view 500 of the footwear article 301 with the convertible heel strap 310 in the first position 319, while FIG. 6 shows a perspective view 600 of the footwear article 302 with the convertible heel strap 310 in the second position 419. As depicted, the interior face of the heel strap 310, specifically the interior face of the heel counter 311, is in face-sharing contact with a heel of a foot placed within the footwear article 302 when the convertible heel strap 310 is in the first position 319. When the convertible heel strap 310 is in the second position 419, the interior face of the heel strap 310, or more specifically the interior face of the heel counter 311, is in face-sharing contact with the cord structure 366, as depicted. In some examples, the convertible heel strap 310 may be secured in the second position 419 by the lace lock 330. For example, the lace lock 330 may be in face-sharing contact with the convertible heel strap 310 to secure the convertible heel strap 310 in the second position 419. Specifically, at least a portion of the exterior face of the convertible heel strap 310, or more specifically at least a portion of the exterior face of the heel counter 311, may be in face-sharing contact with at least a portion of an interior face of the lace lock 330 (i.e., the surface of the lace lock 330 oriented towards the sole 352).

Thus, different embodiments of a footwear article including a convertible heel strap are provided. In one embodiment, a footwear article comprises a first cord forming a first plurality of loops, a second cord forming a second plurality of loops, the second plurality of loops slippably-engaged and intertwined with the first plurality of loops to form at least a portion of an upper configured to at least partially enclose a foot, and a heel strap comprising a heel counter and a connection cord, the connection cord fixedly intertwined with at least the first cord, the heel strap is adjustable from a first position to a second position.

In a first example of the footwear article, the heel strap is adjustable from the first position to the second position by rotating the heel strap relative to a coupling between the connection cord and the first cord. In a second example of the footwear article optionally including the first example, the footwear article further comprises a lace cord laced through a subset of the second plurality of loops, wherein the lace cord and the first cord are laced through a lace lock, and wherein the lace lock secures the heel counter when the heel strap is in the second position. In a third example of the footwear article optionally including one or more of the first and second examples, the footwear article further comprises an upper structure formed from fabric, wherein the first cord passes through a first channel in the upper structure and the second cord passes through a second channel in the upper structure, wherein the second cord loops around the first cord adjacent to the second channel, and wherein the connection cord is coupled to the first cord adjacent to the first channel. In a fourth example of the footwear article optionally including one or more of the first through third examples, the connection cord is stretchable for securing the foot within the footwear article when the heel strap is in the first position. In a fifth example of the footwear article optionally including one or more of the first through fourth examples, the footwear article comprises a partially-closed-heel footwear article when the heel strap is in the first position and an open-heel footwear article when the heel strap is in the second position. In a sixth example of the footwear article optionally including one or more of the first through fifth examples, the first cord forms a rand substructure including a plurality of vamp connection bights, wherein the second cord forms a vamp substructure including a plurality of rand connection bights, and wherein the first plurality of loops intertwined with the second plurality of loops comprises the plurality of vamp connection bights intertwined with the plurality of rand connection bights. In a seventh example of the footwear article optionally including one or more of the first through sixth examples, the first cord, the second cord, and the connection cord are flexible to bend in any direction, yet retain their shape at least partially in a free-state.

In another embodiment, a footwear article comprises a first cord forming a first plurality of loops, a second cord forming a second plurality of loops, the second plurality of loops slippably-engaged and intertwined with the first plurality of loops to form at least a portion of an upper configured to at least partially enclose a foot, and a heel strap comprising a heel counter and a connection cord, the connection cord fixedly intertwined with at least the first cord, the heel strap adjustable from a first position to a second position, wherein the heel strap secures the foot within the footwear article in the first position and does not secure the foot within the footwear article in the second position.

In a first example of the footwear article, the footwear article further comprises a fabric upper structure, the fabric upper structure comprising a first channel through which the first cord is threaded and a second channel through which the second cord is threaded. In a second example of the footwear article optionally including the first example, the first channel and the second channel are adjacent to each other in the fabric upper structure, and the second cord loops around a portion of the first cord extending from a first end of the first channel to form a loop and passes back through the second channel. In a third example of the footwear article optionally including one or more of the first and second examples, the connection cord loops around the portion of the first cord extending from the first channel to form a connection loop between the first cord extending from the first channel and the loop of the second cord. In a fourth example of the footwear article optionally including one or more of the first through third examples, the footwear article further comprises a tongue and a second fabric upper structure, the fabric upper structure positioned on a medial side of the footwear article and the second fabric upper structure positioned opposite the fabric upper structure on a lateral side of the footwear article. In a fifth example of the footwear article optionally including one or more of the first through fourth examples, the second fabric upper structure comprises a third channel and a fourth channel, wherein the first cord extends from a second end of the first channel of the fabric upper structure towards the tongue, passes over the tongue, and extends through the third channel of the second fabric upper structure. In a sixth example of the footwear article optionally including one or more of the first through fifth examples, the second cord is threaded through the fourth channel of the second fabric upper structure, and wherein the second cord loops around a portion of the first cord extending from a first end of the third channel to form a second loop and passes back through the fourth channel. In a seventh example of the footwear article optionally including one or more of the first through sixth examples, the connection cord loops around the portion of the first cord extending from the third channel to form a second connection loop between the first cord extending from the third channel and the second anchor loop of the second cord.

In yet another embodiment, a footwear article comprises a sole, a first cord forming a first plurality of loops, the first cord engaged with the sole, a second cord forming a second plurality of loops, the second plurality of loops slippably-engaged and intertwined with the first plurality of loops to form at least a portion of an upper configured to at least partially enclose a foot, a lace cord laced through a subset of the second plurality of loops, and a heel strap comprising a heel counter and a connection cord, the connection cord intertwined with at least the first cord, the heel strap is adjustable from a first position to a second position, wherein the heel strap secures the foot within the footwear article in the first position and does not secure the foot within the footwear article in the second position.

In a first example of the footwear article, the footwear article further comprises a first fabric upper structure and a second fabric upper structure, the first fabric upper structure positioned on a medial side of the footwear article and the second fabric upper structure positioned opposite the first fabric upper structure on a lateral side of the footwear article, wherein the first cord and second cord are threaded through channels of the first fabric upper structure and the second fabric upper structure. In a second example of the footwear article optionally including the first example, the connection cord is intertwined with at least the first cord at the channels of the first fabric upper structure and the second fabric upper structure. In a third example of the footwear article optionally including one or more of the first and second examples, the footwear article further comprises a lace lock, wherein ends of the lace cord are coupled to the lace lock for adjusting tension of the lace cord, and wherein the lace lock secures the heel strap in the second position.

In another representation, a footwear article comprises a sole, a first cord forming a first plurality of loops, the first cord engaged with the sole, a second cord forming a second plurality of loops, the second plurality of loops slippably-engaged and intertwined with the first plurality of loops to form at least a portion of an upper configured to at least partially enclose a foot, a lace cord laced through a subset of the second plurality of loops, and a heel strap comprising a heel counter and a connection cord, the connection cord fixedly intertwined with at least the first cord, the heel strap is adjustable from a first position to a second position.

In a first example of the footwear article, the heel strap is adjustable from the first position to the second position by rotating the heel strap relative to a coupling between the connection cord and the first cord. In a second example of the footwear article optionally including the first example, the lace cord and the first cord are laced through a lace lock, and wherein the lace lock secures the heel counter when the heel strap is in the second position. In a third example of the footwear article optionally including one or more of the first and second examples, the footwear article further comprises an upper structure formed from fabric, wherein the first cord passes through a first opening in the upper structure and the second cord passes through a second opening in the upper structure, wherein the second cord loops around the first cord adjacent to the second opening, and wherein the connection cord is coupled to the first cord adjacent to the first opening. In a fourth example of the footwear article optionally including one or more of the first through third examples, the connection cord is stretchable for securing the foot within the footwear article when the heel strap is in the first position. In a fifth example of the footwear article optionally including one or more of the first through fourth examples, the footwear article comprises a partially-closed-heel footwear article when the heel strap is in the first position and an open-heel footwear article when the heel strap is in the second position. In a sixth example of the footwear article optionally including one or more of the first through fifth examples, the first cord forms a rand substructure including a plurality of vamp connection bights, wherein the second cord forms a vamp substructure including a plurality of rand connection bights, and wherein the first plurality of loops intertwined with the second plurality of loops comprises the plurality of vamp connection bights intertwined with the plurality of rand connection bights. In a seventh example of the footwear article optionally including one or more of the first through sixth examples, the first cord, the second cord, and the connection cord are flexible to bend in any direction, yet retain their shape at least partially in a free-state.

In another representation, a footwear article comprises a first cord forming a first plurality of loops, a second cord forming a second plurality of loops, the second plurality of loops slippably-engaged and intertwined with the first plurality of loops to form at least a portion of an upper configured to at least partially enclose a foot, and a heel strap comprising a heel counter and a connection cord, the connection cord fixedly intertwined with at least the first cord, the heel strap adjustable from a first position to a second position, wherein the footwear article comprises a partially-closed-heel footwear article when the heel strap is in the first position and an open-heel footwear article when the heel strap is in the second position.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and sub-combinations of the various features, functions, acts, and/or properties disclosed herein, as well as any and all equivalents thereof.

The invention claimed is:

1. A footwear article, comprising:

a first cord forming a first plurality of loops;

a second cord forming a second plurality of loops, the second plurality of loops slippably-engaged and intertwined with the first plurality of loops to form at least a portion of an upper configured to at least partially enclose a foot; and a heel strap comprising a heel counter and a connection cord, wherein the first cord and the second cord are intertwined to form a loop, wherein the connection cord is fixedly intertwined with at least the first cord at the loop, and the heel strap is adjustable from a first position to a second position.

2. The footwear article of claim 1, wherein the heel strap is adjustable from the first position to the second position by rotating the heel strap relative to a coupling between the connection cord and the first cord.

3. The footwear article of claim 1, further comprising a lace cord laced through a subset of the second plurality of loops, wherein the lace cord and the first cord are laced through a lace lock, and wherein the lace lock secures the heel counter when the heel strap is in the second position.

4. The footwear article of claim 1, further comprising an upper structure formed from fabric, wherein the first cord passes through a first channel in the upper structure and the second cord passes through a second channel in the upper structure, wherein the second cord loops around the first cord adjacent to the second channel, and wherein the connection cord is coupled to the first cord adjacent to the first channel.

5. The footwear article of claim 1, wherein the connection cord is stretchable for securing the foot within the footwear article when the heel strap is in the first position.

6. The footwear article of claim 1, wherein the footwear article comprises a partially-closed-heel footwear article when the heel strap is in the first position and an open-heel footwear article when the heel strap is in the second position.

7. The footwear article of claim 1, wherein the first cord forms a rand substructure including a plurality of vamp connection bights, wherein the second cord forms a vamp substructure including a plurality of rand connection bights, and wherein the first plurality of loops intertwined with the second plurality of loops comprises the plurality of vamp connection bights intertwined with the plurality of rand connection bights.

8. The footwear article of claim 1, wherein the first cord, the second cord, and the connection cord are flexible to bend in any direction, yet retain their shape at least partially in a free-state.

9. A footwear article, comprising:

a first cord forming a first plurality of loops;

a second cord forming a second plurality of loops, the second plurality of loops slippably-engaged and intertwined with the first plurality of loops to form at least a portion of an upper configured to at least partially enclose a foot;

a heel strap comprising a heel counter and a connection cord, the connection cord fixedly intertwined with at least the first cord, the heel strap adjustable from a first position to a second position, wherein the heel strap is configured to secure the foot within the footwear article in the first position and wherein the heel strap is configured to not secure the foot within the footwear article in the second position; and a fabric upper structure, the fabric upper structure comprising a first channel through which the first cord is threaded and a second channel through which the second cord is threaded, wherein the first channel and the second channel are adjacent to each other in the fabric upper structure, wherein the second cord loops around a portion of the first cord extending from a first end of the first channel to form a loop and passes back through the second channel, wherein the connection cord loops around the portion of the first cord extending from the first channel to form a connection loop between the first cord extending from the first channel and the loop of the second cord.

10. The footwear article of claim 9, further comprising a tongue and a second fabric upper structure, the fabric upper structure positioned on a medial side of the footwear article and the second fabric upper structure positioned opposite the fabric upper structure on a lateral side of the footwear article.

11. The footwear article of claim 10, wherein the second fabric upper structure comprises a third channel and a fourth channel, wherein the first cord extends from a second end of the first channel of the fabric upper structure towards the tongue, passes over the tongue, and extends through the third channel of the second fabric upper structure.

12. The footwear article of claim 11, wherein the second cord is threaded through the fourth channel of the second fabric upper structure, and wherein the second cord loops around a portion of the first cord extending from a first end of the third channel to form a second loop and passes back through the fourth channel.

13. The footwear article of claim 12, wherein the connection cord loops around the portion of the first cord extending from the third channel to form a second connection loop between the first cord extending from the third channel and the second loop of the second cord.

14. A footwear article, comprising:

a sole;

a first cord forming a first plurality of loops, the first cord engaged with the sole;

a second cord forming a second plurality of loops, the second plurality of loops slippably-engaged and intertwined with the first plurality of loops to form at least a portion of an upper configured to at least partially enclose a foot;

a lace cord laced through a subset of the second plurality of loops;

a heel strap comprising a heel counter and a connection cord, the connection cord intertwined with at least the first cord, the heel strap is adjustable from a first position to a second position, wherein the heel strap is configured to secure the foot within the footwear article in the first position and wherein the heel strap is configured to not secure the foot within the footwear article in the second position; and a first fabric upper structure and a second fabric upper structure, the first fabric upper structure positioned on a medial side of the footwear article and the second fabric upper structure positioned opposite the first fabric upper structure on a lateral side of the footwear article, wherein the first cord and the second cord are threaded through channels of the first fabric upper structure and the second fabric upper structure, wherein the connection cord is intertwined with at least the first cord at the channels of the first fabric upper structure and the second fabric upper structure.

15. The footwear article of claim 14, further comprising a lace lock, wherein ends of the lace cord are coupled to the lace lock for adjusting tension of the lace cord, and wherein the lace lock secures the heel strap in the second position.

* * * * *